US005114620A

United States Patent [19]

Garvey et al.

[11] Patent Number: 5,114,620

[45] Date of Patent: May 19, 1992

[54] LIQUID NON-AQUEOUS CLEANING PRODUCTS COMPRISING A DISPERSION MODIFIER AND METHOD FOR THEIR PREPARATIONS

[75] Inventors: Michael J. Garvey, Wirral; Ian C. Griffiths, Bebington, both of United Kingdom

[73] Assignee: Lever Brothers Company, Division of Conopco, Inc., New York, N.Y.

[21] Appl. No.: 418,065

[22] Filed: Oct. 6, 1989

[30] Foreign Application Priority Data

Oct. 14, 1988 [GB] United Kingdom ..... 8824110

[51] Int. Cl.[5] ..... C11D 1/12; C11D 1/755

[52] U.S. Cl. ..... 252/558; 252/559; 252/540; 252/DIG. 1; 252/DIG. 4; 252/DIG. 14

[58] Field of Search ..... 252/558, DIG. 4, DIG. 1, 252/DIG. 14, 559, 540

[56] References Cited

U.S. PATENT DOCUMENTS

| | | | |
|---|---|---|---|
| 3,778,226 | 12/1973 | Kissa | 8/115.6 |
| 4,123,395 | 10/1978 | Maguire, Jr. et al. | 252/559 |
| 4,277,379 | 7/1981 | Hermann et al. | 252/608 |
| 4,370,144 | 1/1983 | Skelly et al. | 8/501 |
| 4,648,983 | 3/1987 | Broze et al. | 252/135 |
| 4,648,987 | 3/1987 | Smith et al. | 252/559 |
| 4,690,771 | 9/1987 | Ouhadi et al. | 252/102 |
| 4,732,697 | 3/1988 | Kyochika et al. | 252/174.24 |
| 4,874,537 | 10/1989 | Peterson | 252/99 |

FOREIGN PATENT DOCUMENTS

| | | |
|---|---|---|
| 266199 | 5/1988 | European Pat. Off. . |
| 247650 | 6/1988 | German Democratic Rep. . |
| 247653 | 6/1988 | German Democratic Rep. . |
| 57-200497 | 3/1982 | Japan . |
| 62-172100 | 12/1987 | Japan . |
| 1507772 | 4/1978 | United Kingdom . |

OTHER PUBLICATIONS

Grant & Mackh's Chemical Dictionary 5th edition McGraw-Hill, NY 1987, p. 561.

European Search Report.

*Primary Examiner*—Prince E. Willis

*Assistant Examiner*—J. Silbermann

*Attorney, Agent, or Firm*—Ronald A. Koatz

[57] ABSTRACT

A non-aqueous liquid cleaning composition comprises solid particles, such as builders, bleaches or abrasives, dispersed in a liquid phase, ideally an alkoxylated liquid surfactant, and, as a dispersion modifier, naphthalene sulphonic acid, a formaldehyde condensate thereof or ideally a mixture of the two.

6 Claims, 1 Drawing Sheet

LIQUID NON-AQUEOUS CLEANING PRODUCTS COMPRISING A DISPERSION MODIFIER AND METHOD FOR THEIR PREPARATIONS

The present invention is concerned with substantially non-aqueous liquid cleaning product compositions of the kind comprising solid particles dispersed in a liquid phase.

Uncontrolled aggregation of solid particles can lead to a number of disadvantages. Where no aggregation occurs particles will eventually settle, leading to the formation of a clear layer at the top of the liquid. More seriously however, close packing of non-aggregated particles can lead to a sediment which is very difficult to redisperse. The rate of sedimentation is a function of particle size and liquid phase viscosity and it has therefore been proposed to stabilize non-aqueous liquids by the use of small particle size and/or by increasing the viscosity of the liquid phase. However, these routes to stabilization are not always convenient.

Where high levels of aggregation or flocculation occur particles may still settle but their sediment volume will be relatively high. Where this volume equals the volume of the liquid composition itself, space filling occurs with little or no formation of a clear layer. At lower volume fractions of the solid phase, aggregated particles will settle more quickly than non-aggregated particles, but generally the sediment will be more easily redispersible.

Further aggregration results in the solid phase playing a more significant role in the viscosity of the total composition, which again may be disadvantageous.

There is therefore a need to be able to tailor a given non-aqueous liquid to a specific degree of particle aggregation so as to generate desired physical properties in the product, this "target" aggregation being a function, inter alia, of the volume fraction of the solid phase, the desired viscosity profile of the composition and the degree of clear layer formation which is acceptable.

European Patent Application no. EP-A-266199 (Unilever) describes a range of materials for stabilizing suspensions. These materials are referred to therein as deflocculants. The materials described in EP 266199 however do not provide sufficient control over the degree of particle aggregation.

We have now found that such aggregation can be controlled by incorporating an effective amount of polycyclic aromatic sulphonic acid in the composition.

The polycyclic aromatic sulphonic acid, which we refer to generally herein was a "dispersion modifier", may be for example naphthalene sulphonic acid or a derivative thereof such as an alkyl modified naphthalene sulphonic acid. However, much preferred are the polymeric derivatives of these materials, in particular the formaldehyde condensates thereof.

Figure 1:
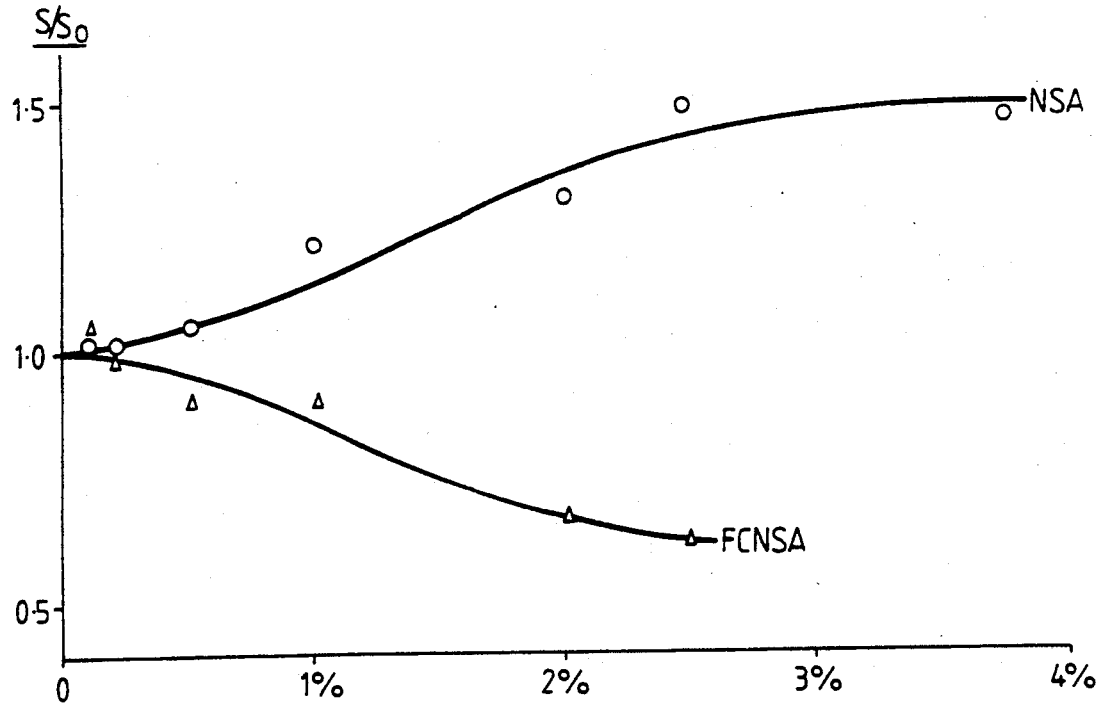
FIG. 1 shows the effects of progressive addition of naphthalene sulphonic acid, and formaldehyde condensates of naphthalene sulphonic acid to zeolite dispersions.

A formaldehyde condensate of naphthalene sulphonic acid (FCNSA) is a polymeric substance having a general formula:

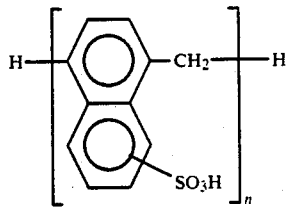

where n is at least 2 but is typically in the range of from 2 to 10.

These acids can exist in salt form, for example as sodium salts. FCNSA salts are available commercially, for example sold under the trade names 'Dispersol' (ICI) or 'Lomar D', 'Lomar PW' and 'Arylan SNS' (Lankro). Materials added in the form of salts per se are insoluble in the usual kinds of liquid phase and are unsuitable. However, the FCNSA's and their derivatives which are in acid form may form salts in situ in the compositions of the present invention and the appended claims are to be interpreted as covering systems with such salts formed in situ by any means whatsoever, provided that the desired rheological effect still results.

The acid forms of FCNSA and its derivatives are commercially available or may be prepared from a corresponding salt such as the sodium salt, by known means, for example by proton exchange.

The FCNSA derivatives referred to herein may for example be analogues of FCNSA where one or more of the sulphonated aryl residues are substituted in the ring system thereof by one or more suitable substitutes such as one or more independently selected hydroxy and/or $C_{1-4}$ alkyl groups. In particular, they may be the acid forms of the aralkylaromatic sulphonate salts described in 'Surface Activity', Moilliet, Collie and Black, Spon, 1961, pp 377-ff.

In sediment volume tests, we have found that FCNSA decreases sediment volume indicative of reduced particle aggregation. On the other hand, the monomeric material, naphthalene sulphonic acid (NSA), increases sediment volume, indicative of increased particle aggregation. It is a preferred feature of the present invention, to utilise a mixture of FCNSA and NSA to achieve a desired sediment volume.

The amount of dispersion modifier which is included in the composition will vary according to the type(s) and amount(s) of material used for both the dispersed solid particles and for the liquid phase. However, typical amounts are from 0.1% to 8% by weight of the total composition, preferably from 1% to 3%.

The liquid phase preferably contains at least some liquid polyalkoxylated material and must be such that the dispersion modifier is at least partly soluble therein, although it is permissible for a portion of the dispersion modifier to be present as dispersed solid. In the context of the present invention, a polyalkoxylated material is any which has a molecule which contains two or more alkoxylene groups, whether the same or different, bonded directly to one another. All references to liquids refer to materials which are liquid at 25° C. at atmospheric pressure.

It is particularly preferred for a major amount, e.g. 50% by weight or greater, of the liquid phase to consist of one or more liquid polyalkoxylated materials.

Especially preferred are liquid polyalkoxylated nonionic surfactants such as are disclosed in our aforementioned EP-A-266,199, relevant parts of which are incorporated herein by reference. Usually, these will be chosen from liquids which are the condensation products of fatty alcohols with lower ($C_{1-4}$) alkylene oxides, especially ethylene oxide and/or propylene oxides. Other suitable polyalkoxylated liquids are poly-lower ($C_{1-4}$) alkylene glycols, especially liquid polyethylene glycols and liquid polypropylene glycols. For example, the polyethylene glycols may be chosen from those which are liquid and have molecular weights in the range of from 200 to 600. Also suitable are alkylene glycol mono- or di-alkyl ethers. Such mono-alkyl ethers are disclosed in British patent specification GB 2,169,613 (Colgate). Typical such di-alkyl ethers are diethylene glycol di-ethyl or di-butyl ether (di-ethyl and di-butyl Carbitol, respectively), most preferably diethylene glycol dimethyl ether (diglyme). The dispersion modifier is insoluble in the latter liquid but when the diglyme is mixed with a polyalkoxylated nonionic surfactant liquid or a liquid polyalkylene glycol, especially a polyethylene glycol, then the polymer can be dissolved. For example, the dispersion modifier can be dissolved in mixtures of diglyme and polyethylene glycol, molecular weight 200, in a weight ratio of 1:3.

Where non-polyalkoxylated liquids are also included, these may be selected from any liquid which is miscible with the liquid polyalkoxylated materials yet does not cause insolubility of the dispersion modifier to the extent that aggregation control is lost. Suitable such liquids are disclosed in said EP-A-266,199.

All compositions according to the present invention are liquid cleaning products. They may be formulated in a very wide range of specific forms, according to the intended use. They may be formulated as cleaners for hard surfaces (with or without abrasive) or as agents for warewashing (cleaning of dishes, cutlery etc) either by hand or mechanical means, as well as in the form of specialised cleaning products, such as for surgical apparatus or artificial dentures. They may also be formulated as agents for washing and/or conditioning of fabrics. When additional ingredients are selected to adapt the basic formulation for the intended purpose, these will be chosen to be compatible therewith, i.e. so as not to destroy the required aggregation control.

In the case of hard-surface cleaning, the compositions may be formulated as main cleaning agents, or pre-treatment products to be sprayed or wiped on prior to removal, e.g. by wiping off or as part of a main cleaning operation.

In the case of warewashing, the compositions may also be the main cleaning agent or a pre-treatment product, e.g. applied by spray or used for soaking utensils in an aqueous solution and/or suspension thereof.

Those products which are formulated for the cleaning and/or conditioning of fabrics constitute an especially preferred form of the present invention because in that role, there is a very great need to be able to incorporate substantial amounts of various kinds of solids. These compositions may for example, be of the kind used for pre-treatment of fabrics (e.g. for pot stain removal) with the composition neat or diluted, before they are rinsed and/or subjected to a main wash. The compositions may also be formulated as main wash products, being dissolved and/or dispersed in the water with which the fabrics are contacted. In that case, the composition may be the sole cleaning agent or an adjunct to another wash product. Within the context of the present invention, the term 'cleaning product' also embraces compositions of the kind used as fabric conditioners (including fabric softeners) which are only added in the rinse water (sometimes referred to as 'rinse conditioners').

Thus, the compositions will contain at least one agent which promotes the cleaning and/or conditioning of the article(s) in question, selected according to the intended application. Usually, this agent will be selected from surfactants, enzymes, bleaches, microbiocides, (for fabrics) fabric softening agents and (in the case of hard surface cleaning) abrasives. Of course in many cases, more than one of these agents will be present, as well as other ingredients commonly used in the relevant product form.

The compositions will be substantially free from agents which are detrimental to the article(s) to be treated. For example, they will be substantially free from pigments or dyes, although of course they may contain small amounts of those dyes (colourants) of the kind often used to impart a pleasing colour to liquid cleaning products, as well as fluorescers, bluing agents and the like.

All ingredients before incorporation will either be liquid, in which case, in the composition they will constitute all or part of the liquid phase, or they will be solids, in which case, in the composition they will either be dispersed as particles in the liquid phase. Thus as used herein, the term "solids" is to be construed as referring to materials in the solid phase which are added to the composition and are dispersed therein in solid form, those solids which dissolve in the liquid phase and those in the liquid phase which solidify (undergo a phase change) in the composition, wherein they are then dispersed.

Thus, where surfactants are solids, they will usually be dissolved or dispersed in the liquid phase. Where they are liquids, they will usually constitute all or part of the liquid phase. However, in some cases the surfactants may undergo a phase change in the composition. In general, they may be chosen from any of the classes, sub-classes and specific materials described in 'Surface Active Agents' Vol. I, by Schwartz & Perry, Interscience 1949 and 'Surface Active' Agents Vol. II by Schwartz, Perry & Berch (Interscience 1958), in the current edition of "McCutcheon's Emulsifiers & Detergents" published by the McCutcheon division of Manufacturing Confectioners Company or in 'Tensid-Taschenbuch', H. Stache, 2nd Edn., Carl Hanser Verlag, München & Wien, 1981.

Nonionic detergent surfactants, both liquid and solid, are well-known in the art. They normally consist of a water-solubilizing polyalkoxylene or a mono- or di-alkanolamide group in chemical combination with an organic hydrophobic group derived, for example, from alkylphenols in which the alkyl group contains from about 6 to about 12 carbon atoms, dialkylphenols in which each alkyl group contains from 6 to 12 carbon atoms, primary, secondary or tertiary aliphatic alcohols (or alkyl-capped derivatives thereof), preferably having from 8 to 20 carbon atoms, monocarboxylic acids having from 10 to about 24 carbon atoms in the alkyl group and polyoxypropylenes. Also common are fatty acid mono- and dialkanolamides in which the alkyl group of the fatty acid radical contains from 10 to about 20 carbon atoms and the alkyloyl group having from 1 to 3 carbon atoms. In any of the mono- and di- alkanolamide derivatives, optionally, there may be a polyoxyalkylene moiety joining the latter groups and the hydrophobic part of the molecule. In all polyalkoxylene containing surfactants, the polyalkoxylene moiety preferably consists of from 2 to 20 groups of ethylene oxide or of ethylene oxide and propylene oxide groups. Amongst the latter class, particularly preferred are those described in European patent specification EP-A-225,654 (Unilever), especially for use as all or part of the solvent. Also preferred are those ethoxylated nonionics which are the condensation products of fatty alcohols with from 9 to 15 carbon atoms condensed with from 3 to 11 moles of ethylene oxide. Examples of these are the condensation products of $C_{11-13}$ alcohols with (say) 3 or 7 moles of ethylene oxide. These may be used as the sole nonionic surfactants or in combination with those of the described in the last-mentioned European specification, especially as all or part of the liquid solvent phase.

Another class of suitable nonionics comprise the alkyl polysaccharides (polyglycosides/oligosaccharides) such as described in any of specifications U.S. Pat. Nos. 3,640,998; 3,346,558; 4,223,129; EP-A-92,355; EP-A-99,183; EP-A-70,074, '75, '76, '77; EP-A-75,994, '95, '96.

Mixtures of different nonionic detergent surfactants may also be used, provided the mixture is liquid at room temperature. Mixtures of nonionic detergent surfactants with other detergent surfactants such as anionic, cationic or ampholytic detergent surfactants and soaps may also be used. If such mixtures are used, the mixture must be liquid at room temperature.

Examples of suitable anionic detergent surfactants are alkali metal, ammonium or alkylolamine salts of alkylbenzene sulphonates having from 10 to 18 carbon atoms in the alkyl group, alkyl and alkylether sulphates having from 10 to 24 carbon atoms in the alkyl group, the alkylether sulphates having from 1 to 5 ethylene oxide groups, olefin sulphonates prepared by sulphonation of $C_{10}$–$C_{24}$ alpha-olefins and subsequent neutralization and hydrolysis of the sulphonation reaction product.

Other surfactants which may be used include alkali metal soaps of a fatty acid, preferably one containing 12 to 18 carbon atoms. Typical such acids are oleic acid, ricinoleic acid and fatty acids derived from caster oil, rapeseed oil, groundnut oil, coconut oil, palmkernal oil or mixtures thereof. The sodium or potassium soaps of these acids can be used. As well as fulfilling the role of surfactants, soaps can act as detergency builders or fabric conditioners, other examples of which will be described in more detail hereinbelow. It can also be remarked that the oils mentioned in this paragraph may themselves constitute part of the liquid phase, whilst the corresponding low molecular weight fatty acids (triglycerides) can be dispersed as solids or function as structurants.

Yet again, it is also possible to utilise cationic, zwitterionic and amphoteric surfactants such as referred to in the general surfactant texts referred to hereinbefore. Examples of cationic detergent surfactants are aliphatic or aromatic alkyl-di(alkyl) ammonium halides and examples of soaps are the alkali metal salts of $C_{12}$–$C_{24}$ fatty acids. Ampholytic detergent surfactants are e.g. the sulphobetaines. Combinations of surfactants from within the same, or from different classes may be employed to advantage for optimising structuring and/or cleaning performance.

The compositions according to the present invention preferably also contain one or more other functional ingredients, for example selected from detergency builders, bleaches or bleach systems, and (for hard surface cleaners) abrasives.

Detergency builders are those materials which counteract the effects of calcium, or other ion, water hardness, either by precipitation or by an ion sequestering effect. They comprise both inorganic and organic builders. They may also be sub-divided into the phosphorus-containing and non-phosphorus types.

In general, the inorganic builders comprise the various phosphate-, carbonate-, silicate-, borate- and aliminosilicate-type materials, particularly the alkali-metal salt forms. Mixtures of these may also be used.

Examples of phosphorus-containing inorganic builders when present include the water-soluble salts, especially alkali metal pyrophosphates, orthophosphates, polyphosphates and phosphonates. Specific examples of inorganic phosphate builders include sodium and potassium phosphates and hexametaphosphates, as well as sodium and potassium tripolyphosphate.

Examples of non-phosphorus-containing inorganic builders, when present, include water-soluble alkali metal carbonates, bicarbonates, borates, silicates, metasilicates, and crystalline and amorphous aluminosilicates. Specific examples include sodium carbonate (with or without calcite seeds), potassium carbonate, sodium and potassium bicarbonates, silicates and zeolites.

The aluminosilicates are an especially preferred class of non-phosphorus inorganic builders. These for example are crystalline or amorphous materials having the general formula:

$$Na_Z(AlO_2)_Z)(SiO_2)_Y \times H_2O$$

wherein Z and Y are integers of at least 6, the molar ratio of Z to Y is in the range from 1.0 to 0.5, and x is an integer from 6 to 189 such that the moisture content is from about 4% to about 20% by weight (termed herein, 'partially hydrated'). This water content provides the best rheological properties in the liquid. Above this level (e.g. from about 19% to about 28% by weight water content), the water level can lead to network formation. Below this level (e.g. from 0 to about 6% by weight water content), trapped gas in pores of the material can be displaced which causes gassing and tends to lead to a viscosity increase also. The preferred range of aluminosilicate is from about 12% to about 30% on an anhydrous basis. The aluminosilicate preferably has a particle size of from 0.1 to 100 microns, ideally between 0.1 to 10 microns and a calcium ion exchange capacity of at least 200 mg calcium carbonate/g.

Examples of organic builders include the alkali metal, ammonium and substituted ammonium, citrates, succinates, malonates, fatty acid sulphonates, carboxymethoxy succinates, ammonium polyacetates, carboxylates, polycarboxylates, aminopolycarboxylates, polyacetyl carboxylates and polyhydroxsulphonates. Specific examples include sodium, potassium, lithium, ammonium and substituted ammonium salts of ethylenediaminetetraacetic acid, nitrilotriacetic acid, oxydisuccinic acid, melitic acid, benzene polycarboxylic acids and citric acid. Other examples are organic phosphonate type sequestering agents such as those sold by Monsanto under the tradename of the Dequest range and alkanehydroxy phosphonates.

Other suitable organic builders include the higher molecular weight polymers and co-polymers known to have builder properties, for example appropriate polyacrylic acid, polymaleic acid and polyacrylic/- polymaleic acid co-polymers as their salts, such as those sold by BASF under the Sokalan Trade Mark.

Suitable bleaches include the halogen, particularly chlorine bleaches such as are provided in the form of alkalimetal hypohalites, e.g. hypochlorites. In the application of fabrics washing, the oxygen bleaches are preferred, for example in the form of an inorganic persalt, preferably with an precursor, or as a peroxy acid compound.

In the case of the inorganic persalt bleaches, the precursor makes the bleaching more effective at lower temperatures, ie. in the range from ambient temperature to about 60° C., so that such bleach systems are commonly known as low-temperature bleach systems and are well known in the art. The inorganic persalt such as sodium perborate, both the monohydrate and the tetrahydrate, acts to release active oxygen in solution, and the precursor is usually an organic compound having one or more reactive acyl residues, which cause the formation of peracids, the latter providing for a more effective bleaching action at lower temperatures than the peroxybleach compound alone. The ratio by weight of the peroxybleach compound to the precursor is from about 15:1 to about 2:1, preferably from about 10:1 to about 3.5:1. Whilst the amount of the bleach system, ie. peroxybleach compound and precursor, may be varied between 5% and about 35% by weight of the total liquid, it is preferred to use from about 6% to about 30% of the ingredients forming the bleach system. Thus, the preferred level of the peroxybleach compound in the composition is between about 5.5% and about 27% by weight, while the preferred level of the precursor is between about 0.5% and about 40%, most preferably between about 1% and about 5% by weight.

Typical examples of the suitable peroxybleach compounds are alkalimetal perborates, both tetrahydrates and monohydrates, alkali metal percarbonates, persilicates and perphosphates, of which sodium perborate is preferred.

Precursors for peroxybleach compounds have been amply described in the literature, including in British patent specifications 836,988, 855,735, 907,356, 907,358, 907,950, 1,003,310 and 1,246,339, U.S. Pat. Nos. 3,332,882, and 4,128,494, Canadian patent specification 844,481 and South African patent specification 68/6,344.

The exact mode of action of such precursors is not known, but it is believed that peracids are formed by reaction of the precursors with the inorganic peroxy compound, which peracids then liberate active-oxygen by decomposition.

They are generally compounds which contain N-acyl or O-acyl residues in the molecule and which exert their activating action on the peroxy compounds on contact with these in the washing liquor. Cationic peracid bleach precursors such as those described in U.S. Pat. Nos. 4,751,015 and 4,397,757 (Lever Bros.) can be included.

When the composition contains abrasives for hard surface cleaning (i.e. is a liquid abrasive cleaner), these will inevitably be incorporated as particulate solids. They may be those of the kind which are water insoluble, for example calcite. Suitable materials of this kind are disclosed in the patent specifications EP-A-50,887; EP-A-80,221; EP-A-140,452; EP-A-214,540 and EP 9,942 (all Unilever) which relate to such abrasives when suspended in aqueous media. Water soluble abrasives may also be used.

Although the dispersion modifiers described herein are excellent agents for controlling particle aggregation, it is also possible simultaneously to include one or more auxiliary materials to tailor the rheological profile as desired. These may be selected from the deflocculants mentioned in EP-A-266 199, for example ABSA or lecithin. Other suitable examples are the highly voluminous inorganic carrier materials described in GB patent specifications 1 205 711 (Unilever) and 1 270 040 (Unilever) and fine particulate chain-structure clay as described in EP-A-34 387 (Procter & Gamble) and viscosity modifiers.

Some of the materials mentioned above for auxiliary rheology control also have a subsidiary function, for example as surfactants or detergency builders.

The compositions of the invention optionally may also contain one or more minor ingredients such as fabric conditioning agents, enzymes, perfumes (including deoperfumes), micro-biocides, colouring agents, fluorescers, soil-suspending agents (anti-redeposition agents), corrosion inhibitors, enzyme stabilizing agents, and lather depressants.

In general, the solids content of the product may be within a very wide range, for example from 1–90%, usually from 10–80% and preferably from 15–70%, especially 15–50% by weight of the final composition.

The compositions are substantially non-aqueous, i.e. they little or no free water, preferably no more than 5%, preferably less than 3%, especially less than 1% by weight of the total composition. It has been found by the applicants that the higher the water content, the more likely it is for the viscosity to be too high, or even for setting to occur.

In the broadest sense, the compositions of the present invention may simply be prepared by admixture of the non-aqueous liquid, the solid material and the deflocculant, optionally followed by reduction, or further size reduction of the solids.

However, since the objective of a non-aqueous liquid will generally be to enable the formulator to avoid the negative influence of water on the components, e.g. causing incompatibility of functional ingredients, it is clearly necessary to avoid the accidental or deliberate addition of water to the product at any stage in its life. For this reason, special precautions are necessary in manufacturing procedures and pack designs for use by the consumer.

Thus during manufacture, it is preferred that all raw materials should be dry and (in the case of hydratable salts) in a low hydration state, e.g. anhydrous phosphate builder, sodium perborate monohydrate and dry calcite abrasive, where these are employed in the composition. In a preferred process, the dry, substantially anhydrous solids are blended with the solvent in a dry vessel. In order to minimise the rate of sedimentation of the solids, this blend is passed through a grinding mill or a combination of mills, e.g. a colloid mill, a corundum disc mill, a horizontal or vertical agitated ball mill, to achieve a particle size of 0.1 to 100 microns, preferably 0.5 to 50 microns, ideally 1 to 10 microns. A preferred combination of such mills is a colloid mill followed by a horizontal ball mill since these can be operated under the conditions required to provide a narrow size distribution in the final product. Of course particulate material already having the desired particle size need not be subjected to this procedure and if desired, can be incorporated during a later stage of processing.

During this milling procedure, the energy input results in a temperature rise in the product and the liberation of air entrapped in or between the particles of the solid ingredients. It is therefore highly desirable to mix any heat sensitive ingredients into the product after the milling stage and a subsequent cooling step. It may also be desirable to de-aerate the product before addition of these (usually minor) ingredients and optionally, at any other stage of the process. Typical ingredients which might be added at this stage are perfumes and enzymes, but might also include highly temperature sensitive bleach components or volatile solvent components which may be desirable in the final composition. However, it is especially preferred that volatile material be introduced after any step of de-aeration. Suitable equipment for cooling (e.g. heat exchangers) and de-aeration will be known to those skilled in the art.

It follows that all equipment used in this process should be completely dry, special care being taken after any cleaning operations. The same is true for subsequent storage and packing equipment.

The present invention will now be illustrated by way of the following Examples.

EXAMPLE 1

Control of aggregation is very clearly demonstrated in model systems with low volume fractions of suspended solids. In such cases, the better the inhibition of flocculation, the less is the sediment volume ratio $S/S_o$ at a given concentration of the additive, where S=sediment volume and $S_o$=sediment volume at 0% additive.

FIG. 1 shows the effects of progressive addition of NSA, and FCNSA respectively, to dispersions of 2.8 g of zeolite (4 micron particle size) (dried at 120° C.) in 7.2 g Dobanol 91-6T surfactant. The measurements were performed using 10 ml samples in measuring cylinders and the results after 20 days are plotted as $S/S_o$ against the percentage concentration of the additive based on the total mixture. The Dobanol is a $C_9$–$C_{11}$ fatty alcohol alkoxylated with an average of 6 moles of ethylene oxide per molecule, ex Shell. The FCNSA was a material supplied by Hodgson Chemicals Limited, England, designated 'Acid Condensate of Suparex M'. It can be seen that while FCNSA clearly inhibits aggregation, NSA brings about a controlled increase in aggregation.

The data on which FIG. 1 is based was as follows:

| Concentration (%) | S/S° (20 days) NSA | FCNSA |
|---|---|---|
| 0.1 | 1.01 | 1.03 |
| 0.2 | 1.00 | 0.99 |
| 0.5 | 1.03 | 0.90 |
| 1.0 | 1.2 | 0.89 |
| 2.0 | 1.3 | 0.67 |
| 2.5 | 1.48 | 0.62 |
| 3.75 | 1.46 | |

EXAMPLE 2

A 55.8% w/w dispersion of zeolite (Wessalith P, 14.5% w/w $H_2O$) in Dobanol 91-6T was prepared using a Silverson mixer. 10 g of the above dispersion were mixed with Dobanol 91-6T, 10% w/w FCNSA in Dobanol 91-6T and 10% w/w NSA in Dobanol 91-6T to give a range of samples containing 27.9% w/w zeolite and FCNSA/NSA concentrations of 3%/0% w/w to 0%/3% w/w.

After thorough mixing on a bottle roller for 3 hrs, 10 $cm^3$ of each sample were transferred to 10 $cm^3$ measuring cylinders and left to stand at 31°±0.5° C. The sediment volume of each sample was monitored.

The results were as follows:

| FCNSA (%) | NSA (%) | S/S° (19 days) |
|---|---|---|
| 3.0 | 0 | 0.88 |
| 2.5 | 0.5 | 0.90 |
| 2.0 | 1.0 | 0.89 |
| 1.5 | 1.5 | 0.92 |
| 1.35 | 1.65 | 0.95 |
| 1.15 | 1.85 | 0.98 |
| 1.0 | 2.0 | 1.16 |
| 0.85 | 2.15 | 1.07 |
| 0.65 | 2.35 | 1.17 |
| 0.5 | 2.5 | 1.28 |
| 0.25 | 2.75 | 1.27 |
| 0 | 3.0 | 1.40 |

Figure 2:
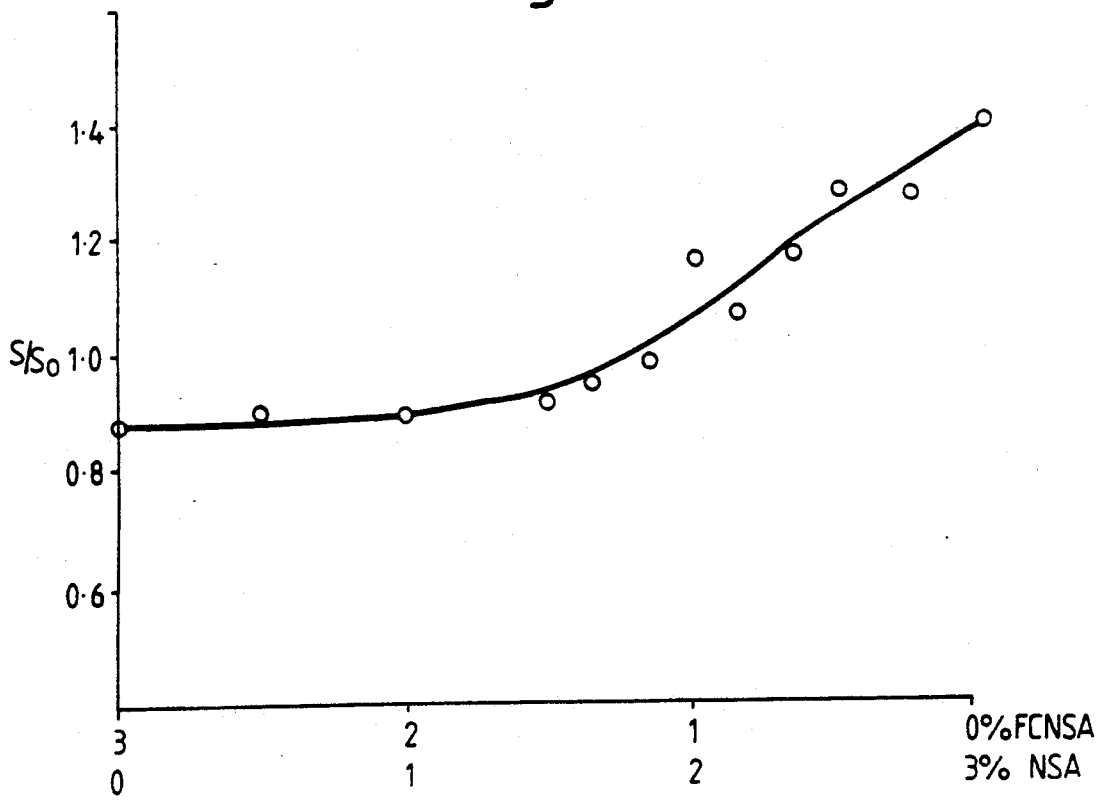
FIG. 2 shows the sediment volume for zeolite dispersion containing naphthalene sulphonic acid or formaldehyde condensates of naphthalene sulphonic acid.

These results are plotted in FIG. 2. FIG. 2 may be used to determine the required ratio of FCNSA to NSA for a desired sediment volume ratio.

| | wt % |
|---|---|
| Dobanol 91/6T (1) | 37.1 |
| Glycerol tri-acetate | 5.0 |
| FCNSA (2) | 2.5 |
| STP (3) | 30.0 |
| Sodium carbonate 0 aq | 4.0 |
| Na Perborate monohydrate | 15.0 |
| EDTA (4) | 0.15 |
| SCMC (5) | 1.0 |
| TAED (6) | 4.0 |
| Dequest 2041 | 0.1 |
| Fluorescer (Tinopal DMS-X) | 0.3 |
| Tylose MH20 | 0.5 |
| Silicone DB100 | 0.25 |
| Savinase 8.0 SL | 0.6 |

(1) (2): as Example 1
(3) Sodium tripolyphosphate
(4) Ethylene diamine tetraacetic acid
(5) Sodium carboxymethylcellulose
(6) Tetraacetyl ethylenediamine This formulation may be prepared by dissolving the sulphonic acid in the liquid phase, and thereafter mixing in the remaining ingredients.

We claim:

1. A non-aqueous liquid cleaning composition comprising from 1% to 90% by weight of a solid phase consisting of solid particles having a particle size of 0.1 to 100 microns, said solid phase being dispersed in a non-aqueous liquid phase, the composition further comprising 0.1% to 8% by weight of a dispersion modifier wherein the dispersion modifier is a mixture of naphthalene sulfonic acid and formaldehyde condensate of naphthalene sulfonic acid in a weight ratio of 11:1 to 1:5.

2. A composition according to claim 1, comprising from 1% to 3% by weight of the dispersion modifier.

3. A composition according to claim 1, in which the liquid phase comprises a polyalkoxylated nonionic surfactant.

4. A composition according to claim 1, wherein the solid phase is selected from detergency builders, bleaches, abrasives and mixtures thereof.

5. A method of controlling the sediment volume of a non-aqueous liquid cleaning composition comprising a solid phase in particulate form dispersed in a liquid phase, by incorporating therein one or more polycyclic aromatic sulphonic acids as a dispersion modifier.

6. A method of preparing a non-aqueous composition comprising a solid phase in particulate form dispersed in a non-aqueous liquid phase and further comprising a polycyclic aromatic sulphonic acid as a dispersion modifier, which method comprises mixing together the non-aqueous liquid phase, the solid phase and the dispersion modifier followed by reduction of the solid phase particle size to 0.1 to 100 microns.

* * * * *